US007993415B2

(12) United States Patent
Vogt et al.

(10) Patent No.: US 7,993,415 B2
(45) Date of Patent: Aug. 9, 2011

(54) FABRICS HAVING A TOPICALLY APPLIED SILVER-BASED FINISH EXHIBITING A REDUCED PROPENSITY FOR DISCOLORATION

(75) Inventors: Kirkland W. Vogt, Simpsonville, SC (US); Jason L. Kreider, Boiling Springs, SC (US); Robert J. Goulet, Woodruff, SC (US)

(73) Assignee: Milliken & Company, Spartanburg, SC (US)

( * ) Notice: Subject to any disclaimer, the term of this patent is extended or adjusted under 35 U.S.C. 154(b) by 896 days.

(21) Appl. No.: 11/985,709

(22) Filed: Nov. 16, 2007

(65) Prior Publication Data

US 2010/0285711 A1 Nov. 11, 2010

Related U.S. Application Data

(62) Division of application No. 10/307,027, filed on Nov. 29, 2002, now abandoned.

(51) Int. Cl.
*C09B 67/00* (2006.01)

(52) U.S. Cl. ..... 8/624; 442/148

(58) Field of Classification Search ..... 442/148, 442/93, 117; 8/618, 624
See application file for complete search history.

(56) References Cited

U.S. PATENT DOCUMENTS

| | | | | |
|---|---|---|---|---|
| 5,265,770 | A | 11/1993 | Matkovich et al. | 222/189 |
| 5,427,844 | A | 6/1995 | Murai et al. | 428/245 |
| 5,709,870 | A | 1/1998 | Yoshimura et al. | 424/404 |
| 5,849,311 | A | 12/1998 | Sawan et al. | 424/406 |
| 6,013,275 | A | 1/2000 | Konagaya et al. | 424/443 |
| 6,641,829 | B1 | 11/2003 | Green et al. | 424/405 |
| 2004/0106342 | A1 | 6/2004 | Sturm et al. | 442/117 |

FOREIGN PATENT DOCUMENTS

| | | |
|---|---|---|
| JP | H11-124729 | 5/1999 |

OTHER PUBLICATIONS

AATCC Test Method 76-1995 "Electrical Resisitivity of Fabrics".
AATCC Test Method 100-1993 "Antibacterial Finishes on Textile Materials: Assessment Of".
AATCC Test Method 130-1995 "Soil Release: Oily Stain Release Method".

*Primary Examiner* — Arti Singh-Pandey
(74) *Attorney, Agent, or Firm* — Brenda D. Wentz

(57) ABSTRACT

Improvements in the wash durability and discoloration levels for fabrics having topically applied silver-ion treatments (such as ion-exchange compounds, like zirconium phosphates, glasses and/or zeolites) are provided. Such solid compounds are generally susceptible to discoloration and, due to the solid nature thereof, are typically easy to remove from topical surface applications. The inventive treatment requires the presence of a specific polyurethane binder, either as a silver-ion overcoat or as a component of a dye bath mixture admixed with the silver-ion antimicrobial compound. In addition, specific metal halide additives (preferably substantially free from sodium ions) are utilized to combat the discolorations typical of such silver-ion formulations. As a result, wash durability, discoloration levels, or both, can be improved to the extent that after a substantial number of standard launderings and dryings, the inventive treatment does not wear away in any appreciable amount and the color of the treatment remains substantially the same as when first applied. The particular treatment method as well as the treated fabrics are also encompassed within this invention.

21 Claims, No Drawings

FABRICS HAVING A TOPICALLY APPLIED SILVER-BASED FINISH EXHIBITING A REDUCED PROPENSITY FOR DISCOLORATION

CROSS-REFERENCE TO RELATED APPLICATIONS

This application claims priority to and is a divisional of U.S. patent application Ser. No. 10/307,027, filed Nov. 29, 2002 , now abandoned. The priority application is hereby entirely incorporated by reference.

FIELD OF THE INVENTION

This invention relates to improvements in the wash durability and discoloration levels for fabrics having topically applied silver-ion treatments (such as ion-exchange compounds, like zirconium phosphates, glasses and/or zeolites). Such solid compounds are generally susceptible to discoloration and, due to the solid nature thereof, are typically easy to remove from topical surface applications. The inventive treatment requires the presence of a specific polyurethane binder, either as a silver-ion overcoat or as a component of a dye bath mixture admixed with the silver-ion antimicrobial compound. In addition, specific metal halide additives (preferably substantially free from sodium ions) are utilized to combat the discolorations typical of such silver-ion formulations. As a result, wash durability, discoloration levels, or both, can be improved to the extent that after a substantial number of standard launderings and dryings, the inventive treatment does not wear away in any appreciable amount and the color of the treatment remains substantially the same as when first applied. The particular treatment method, as well as the treated fabrics, is also encompassed within this invention.

DISCUSSION OF THE PRIOR ART

There has been a great deal of attention in recent years given to the hazards of bacterial contamination from potential everyday exposure. Noteworthy examples of such concern include the fatal consequences of food poisoning due to certain strains of *Escherichia coli* being found within undercooked beef in fast food restaurants; *Salmonella* contamination causing sicknesses from undercooked and unwashed poultry food products; and illnesses and skin infections attributed to *Staphylococcus aureus, Klebsiella pneumoniae*, yeast, and other unicellular organisms. With such an increased consumer interest in this area, manufacturers have begun introducing antimicrobial agents within various household products and articles. For instance, certain brands of polypropylene cutting boards, liquid soaps, etc., all contain antimicrobial compounds. The most popular antimicrobial for such articles is triclosan.

Although the incorporation of such a compound within liquid or polymeric media has been relatively simple, other substrates, including the surfaces of textiles and fibers, have proven less accessible. There is a long-felt need to provide effective, durable, and long-lasting antimicrobial characteristics for textile surfaces, in particular on apparel fabrics, and on film surfaces. Such proposed applications have been extremely difficult to accomplish with triclosan, particularly when wash durability is a necessity (triclosan easily washes off any such surfaces). Furthermore, although triclosan has proven effective as an antimicrobial compound, the presence of chlorines and chlorides within such a compound causes skin irritation which makes the utilization of such with fibers, films, and textile fabrics for apparel uses highly undesirable. Furthermore, there are commercially available textile products comprising acrylic and/or acetate fibers co-extruded with triclosan (for example Celanese markets such acetate fabrics under the name Microsafe® and Acordis markets such acrylic fibers, either under the tradename Amicor®). However, such an application is limited to those types of fibers; it does not work specifically for and within polyester, polyamide, cotton, spandex, etc., fabrics. Furthermore, this co-extrusion procedure is very expensive.

Silver-containing inorganic microbiocides have recently been developed and utilized as antimicrobial agents on and within a plethora of different substrates and surfaces. In particular, such microbiocides have been adapted for incorporation within melt spun synthetic fibers, as taught within Japanese unexamined Patent Application No. H11-124729, in order to provide certain fabrics which selectively and inherently exhibit antimicrobial characteristics. Furthermore, attempts have been made to apply such specific microbiocides on the surfaces of fabrics and yarns with little success from a durability standpoint. A topical treatment with such compounds has never been successfully applied as a durable finish or coating on a fabric or yarn substrate. Although such silver-based agents provide excellent, durable, antimicrobial properties, to date such is the sole manner available within the prior art of providing a long-lasting, wash-resistant, silver-based antimicrobial textile. However, such melt spun fibers are expensive to make due to the large amount of silver-based compound required to provide sufficient antimicrobial activity in relation to the migratory characteristics of such a compound within the fiber itself to its surface.

A topical coating is also desirable for textile and film applications, particularly after finishing of the target fabric or film. Such a topical procedure permits treatment of a fabric's individual fibers prior to or after weaving, knitting, and the like, in order to provide greater versatility to the target yarn without altering its physical characteristics. Such a coating, however, must prove to be wash durable, particularly for apparel fabrics, in order to be functionally acceptable. Furthermore, in order to avoid certain problems, it is highly desirable for such a metallized treatment to be electrically non-conductive on the target fabric, yarn, and/or film surface. With the presence of metals and metal ions, such a wash durable, non-electrically conductive coating has not been available in the past. Such an improvement would thus provide an important advancement within the textile, yarn, and film art. Although antimicrobial activity is one desired characteristic of the inventive metal-treated fabric, yarn, or film, this is not a required property of the inventive article. Odor-reduction, heat retention, distinct colorations, reduced discolorations, improved yarn and/or fabric strength, resistance to sharp edges, etc., are all either individual or aggregate properties which may be accorded the user of such an inventive treated yarn, fabric, or film.

Furthermore, topical applications of silver-ion based compounds generally exhibit aesthetically displeasing discolorations due to oxidation of the silver-ions themselves. Typically, a variety of hues (from yellow to grey to black) are prominent during and after exposure to atmospheric conditions. Thus, there remains a need to provide improvements for such topical treatments as well. To date, the difficulties with discoloration have gone noticed but unremedied.

DESCRIPTION OF THE INVENTION

It is thus an object of the invention to provide a simple manner of effectively treating a textile with a highly wash-durable antimicrobial silver-ion containing treatment. Another object of the invention is to provide an aesthetically pleasing metal-ion-treated textile which is highly wash durable, substantially non-discoloring, non-irritating to skin, and which provides antimicrobial and/or odor control properties.

Accordingly, this invention encompasses a non-electrically conductive fabric substrate having a surface, a portion of which is coated with a finish, wherein said finish comprises at least one silver-ion containing compound, a binder, and at least one halide-containing compound, wherein said halide-containing compound is present in an amount measured as a molar ratio between the amount of halide ions present and the amount of silver ions present, wherein said range is from 5:1 to 1:10, and wherein said finish is substantially free from alkali metal (such as, preferably, sodium, ions). Also encompassed within this invention is a fabric substrate having a surface, a portion of which is coated with a non-electrically conductive finish, wherein said finish comprises at least one silver-ion containing compound and a binder; wherein said treated fabric exhibits a silver-ion release retention level of at least 50%, with an initial amount of available silver ion of at least 1000 ppb, as measured by an artificial sweat comparison test, wherein said silver-ion release retention level is measured after at least 20 washes, said washes being performed in accordance with the wash procedure as part of AATCC Test Method 130-1981. Further encompassed by this invention is a fabric substrate having a surface, a portion of which is coated with a finish, wherein said finish comprises at least one silver-ion containing compound, a binder, and at least a 1:1 molar ratio of said silver-ion containing compound to halide ions, wherein said finish is substantially free from sodium ions.

Also encompassed within this invention is a fabric substrate having a surface, a portion of which is coated with a non-electrically conductive finish, wherein said finish comprises at least one silver-ion containing compound and a binder; wherein said treated fabric exhibits a color stabilization rate of at least 50% wherein said color stabilization rate is measured after at least 20 washes, said washes being performed in accordance with the wash procedure as part of AATCC Test Method 130-1981.

The wash durability test noted above is standard and, as will be well appreciated by one of ordinary skill in this art, is not intended to be a required or limitation within this invention. Such a test method merely provides a standard which, upon 10 washes in accordance with such, the inventive treated substrate will not lose an appreciable amount of its electrically non-conductive metal finish.

Nowhere within the prior art has such a specific treated substrate or method of making thereof been disclosed, utilized, or fairly suggested. The closest art is a product marketed under the tradename X-STATIC® which is a fabric article electrolessly plated with a silver coating. Such a fabric is highly electrically conductive and is utilized for static charge dissipation. Also, the coating alternatively exists as a removable silver powder finish on a variety of surfaces. The aforementioned Japanese patent publication to Kuraray is limited to fibers within which a silver-based compound has been incorporated through melt spun fiber techniques. Nowhere has such a wash-durable topical treatment as now claimed been mentioned or alluded to.

Any fabric may be utilized as the substrate within this application. Thus, natural (cotton, wool, and the like) or synthetic fibers (polyesters, polyamides, polyolefins, and the like) may constitute the target substrate, either by itself or in any combinations or mixtures of synthetics, naturals, or blends or both types. As for the synthetic types, for instance, and without intending any limitations therein, polyolefins, such as polyethylene, polypropylene, and polybutylene, halogenated polymers, such as polyvinyl chloride, polyesters, such as polyethylene terephthalate, polyester/polyethers, polyamides, such as nylon 6 and nylon 6,6, polyurethanes, as well as homopolymers, copolymers, or terpolymers in any combination of such monomers, and the like, may be utilized within this invention. Nylon 6, Nylon 6,6, polypropylene, and polyethylene terephthalate (a polyester) are particularly preferred. Additionally, the target fabric may be coated with any number of different films, including those listed in greater detail below. Furthermore, the substrate may be dyed or colored to provide other aesthetic features for the end user with any type of colorant, such as, for example, poly(oxyalkylenated) colorants, as well as pigments, dyes, tints, and the like.

Other additives may also be present on and/or within the target fabric or yarn, including antistatic agents, brightening compounds, nucleating agents, antioxidants, UV stabilizers, fillers, permanent press finishes, softeners, lubricants, curing accelerators, and the like. Particularly desired as optional and supplemental finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture. The preferred soil release agents contemplated within this invention may be found in U.S. Pat. Nos. 3,377,249; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference. Additionally, other potential additives and/or finishes may include water repellent fluorocarbons and their derivatives, silicones, waxes, and other similar water-proofing materials.

The particular treatment must comprise at least one type of silver-ion containing compounds, or mixtures thereof of different types. The term silver-ion containing compound encompasses compounds which are either ion-exchange resins, zeolites, or, possibly substituted glass compounds (which release the particular metal ion bonded thereto upon the presence of other anionic species). The preferred silver-ion containing compound for this invention is an antimicrobial silver zirconium phosphate available from Milliken & Company, under the tradename ALPHASAN®. Other potentially preferred silver-containing antimicrobials in this invention is a silver zeolite, such as those available from Sinanen under the tradename ZEOMIC® AJ, or a silver glass, such as those available from Ishizuka Glass under the tradename ION-PURE®, may be utilized either in addition to or as a substitute for the preferred species. Generally, such a metal compound is added in an amount of from about 0.01 to about 40% by total weight of the particular treatment composition; more preferably from about 0.05 to about 30%; and most preferably from about 0.1 to about 30%. Preferably this metal compound is present in an amount of from about 0.01 to about 5% owf, preferably from about 0.05 to about 3% owf, more preferably from about 0.1 to about 2% owf, and most preferably about 1.0% owf. The treatment itself, including any necessary binders, leveling agents, adherents, thickeners, and the like, is added to the substrate in an amount of about 0.01 to about 10% owf. Of particular interest are anti-soil redeposition polymers, such as certain ethoxylated polyesters PD-92 and DA-50, both available from Milliken & Company, or Milease®, available from Clariant.

The binder material, although optional in some embodiments, does provide highly beneficial durability for the inventive yarns. Preferably, this component is a polyurethane-based binding agent, although other types, such as a permanent press type resin or an acrylic type resin, may also be utilized in combination, particularly, with the halide ion additive for discoloration reduction. In essence, such resins provide washfastness by adhering silver to the target yarn and/or fabric surface, with the polyurethane exhibiting the best overall performance for wash durability results.

The selected substrate may be any fabric comprising individual fibers or yarns of any typical source for utilization within fabrics, including natural fibers (cotton, wool, ramie, hemp, linen, and the like), synthetic fibers (polyolefins, polyesters, polyamides, polyaramids, acetates, rayon, acrylics, and the like), and inorganic fibers (fiberglass, boron fibers, and the like). The yarn or fiber may be of any denier, may be of multi- or mono-filament, may be false-twisted or twisted, or may incorporate multiple denier fibers or filaments into one single yarn through twisting, melting, and the like. The target fabrics may be produced of the same types of yarns discussed above, including any blends thereof. Such fabrics may be of any standard construction, including knit, woven, or non-woven forms. The inventive fabrics may be utilized in any suitable application, including, without limitation, apparel, upholstery, bedding, wiping cloths, towels, gloves, rugs, floor mats, drapery, napery, bar runners, textile bags, awnings, vehicle covers, boat covers, tents, and the like. The inventive fabric may also be coated, printed, colored, dyed, and the like.

The preferred procedures utilizing silver-ion containing compounds, such as either ALPHASAN®, ZEOMIC®, or IONPURE® as preferred compounds (although any similar types of compounds which provide silver ions may also be utilized), exhausted on the target fabric or film surface and then overcoated with a binder resin. Alternatively, the silver-ion containing compound may be admixed with a binder within a dye bath, into which the target fabric is then immersed at elevated temperatures (i.e., above about 50° C.).

In terms of wash durability, such a procedure was developed through an initial attempt at understanding the ability of such metal-ion containing compounds to attach to a fabric surface. Thus, a sample of ALPHASAN® was first exhausted from a dye bath on to a target polyester fabric surface. The treated fabric exhibited excellent log kill rate characteristics; however, upon washing in a standard laundry method (AATCC Test Method 130-1981, for instance), the antimicrobial activity was drastically reduced. Such promising initial results led to the inventive wash-durable antimicrobial treatment wherein the desired metal-ion containing compound would be admixed or overcoated with a binder resin on the target fabric surface.

It was initially determined that proper binder resins could be selected from the group consisting of nonionic permanent press binders (i.e., cross-linked adhesion promotion compounds, including, without limitation, cross-linked imidazolidinones, available from Sequa under the tradename Permafresh®) or slightly anionic binders (including, without limitation, acrylics, such as Rhoplex® TR3082 from Rohm & Haas). Other nonionics and slightly anionics were also possible, including melamine formaldehyde, melamine urea, ethoxylated polyesters (such as Lubril QCX™, available from Rhodia), and the like. However, it was found that the wash durability of such treated fabrics (in terms of silver-ion retention, at least) was limited. It was determined that greater durability was required for this type of application. Thus, these prior comparative treatments were measured against various other types. In the end, it was discovered that certain polyurethane binders (such as Witcobond® from Crompton Corporation) and acrylic binders (such as Hystretch® from BFGoodrich) permitted the best overall wash durability to the solid silver-ion compound adhesion to the target fabric surfaces, as discussed in greater detail below.

Within the particular topical application procedures, the initial exhaustion of the silver-ion compound (preferably, ALPHASAN®) is thus preferably followed by a thin coating of polyurethane-based binder resin to provide the desired wash durability characteristics for the metal-based particle treatment. With such specific polyurethane-based binder materials utilized, the antimicrobial characteristics of the treated fabric remained very effective for the fabric even after as many as ten standard laundering procedures.

Also possible, though less effective as compared to the aforementioned binder resin overcoat, but still an acceptable method of providing a wash-durable antimicrobial metal-treated fabric surface, is the application of a silver-ion containing compound/polyurethane-based binder resin from a dye bath mixture. The exhaustion of such a combination is less efficacious from an antimicrobial activity standpoint than the other overcoat, but, again, still provides a wash-durable treatment with acceptable antimicrobial benefits. In actuality, this mixture of compound/resin may be applied through spraying, dipping, padding, and the like.

In terms of discoloration, it was noticed that silver-ion topical treatments were susceptible to yellowing, browning, graying, and, possibly, blacking after exposure to atmospheric conditions. As silver ions are generally highly reactive with free anions, and most anions that react with silver ions produce color, a manner of curtailing if not outright preventing problematic color generation upon silver ion interactions with free anionic species, particularly within dye bath liquids, was required. Thus, it was theorized that inclusion of an additive that was non-discoloring itself, would not react deleteriously with the binder and/or silver-ion compound, and would, apparently, and without being bound to any specific scientific theory, react in such a manner as to provide a colorless salt with silver ions, was highly desired.

Halide ions, such as from metal halides (magnesium chloride, for example) or hydrohalic acids (HCl for example) provide such results, apparently, with the exception that the presence of sodium ions (which are of the same valence as silver ions, and compete with silver ions for reaction with halide ions) should be avoided, since such components prevent the production of colorless silver halides, leaving the free silver ions the ability to react thereafter with undesirable anions. Thus, the presence of such monovalent sodium ions (as well as other monovalent alkali metal ions, such as potassium, cesium, and lithium, at times) does not provide the requisite level of discoloration reduction to the degree needed. In general, amounts of 1000 ppm or greater of sodium ions within the finish composition, particularly within the solvent (water, for example) are deleterious to the discoloration prevention of the inventive topically applied treatments. Thus, this threshold amount is encompassed by the term "substantially free from sodium ions" as it pertains to this invention.

Furthermore, the bivalent or trivalent (and some monovalent) metal halide counteracts some effects of sodium ion exposure if present in a sufficient amount within the finish composition. Thus, higher amounts of sodium or like alkali metal ions are present within the finish composition, higher amounts of metal halide (magnesium chloride, for example)

can counterbalance such to the extent that discoloration can be properly prevented. Furthermore, all other metal ions (bivalents, trivalents, and the like, with bivalents, such as magnesium, most preferred) combined with halide anions (such as chloride, bromides, iodides, as examples, with chlorides most preferred), as well as acids (again, HCl, as well as HBr, and the like) are potential additives for discoloration prevention within this invention. The amount of chloride ion (concentrations) should be measured in terms of molar ratios with the free silver ions available within the silver-ion containing compound. A range of ratios from 1:10 (chloride to silver ion) to 5:1 (chloride to silver ion) should be met for proper activity; preferably this range is from 1:2 to about 2.5:1. Again, higher amounts of metal halide in molar ratio to the silver ions may be added to counteract any excess alkali metal ion amounts within the finish composition itself.

The preferred embodiments of these inventive fabric treatments (whether it be wash durable, non-discoloring, or both) are discussed in greater detail below.

DESCRIPTION OF THE PREFERRED EMBODIMENTS

The following examples further illustrate the present invention but are not to be construed as limiting the invention as defined in the claims appended hereto. All parts and percents given in these examples are by weight unless otherwise indicated.

Initially, solutions of ALPHASAN® (silver-based ion exchange compound available from Milliken & Company) were produced for topical application via dye bath exhaustion to target fabrics. These solutions, with comparatives as well, were as follows:

Example 1

| Component | Amount (% by weight) |
|---|---|
| Water | 94.15 |
| PD-92 (anti-soil redeposition polymer) | 1.5 |
| DA-50 (anti-soil redeposition polymer) | 1.5 |
| Witcobond | 2.25 |
| Alphasan | 0.6 |
| Acetic Acid | to adjust pH to 6.5 |

Example 2

| Component | Amount (% by weight) |
|---|---|
| Water | 97.8 |
| PD-92 | 0.75 |
| DA-50 | 0.75 |
| Witcobond | 1.12 |
| Alphasan | 0.3 |
| Acetic Acid | to adjust pH to 6.5 |

Example 3

| Component | Amount (% by weight) |
|---|---|
| Water | 92.7 |
| PD-92 | 1.5 |
| DA-50 | 1.5 |
| Hystretch | 3.7 |
| Alphasan | 0.6 |
| Acetic Acid | to adjust pH to 6.5 |

Example 4

| Component | Amount (% by weight) |
|---|---|
| Water | 93.1 |
| Milease (anti-soil redeposition polymer) | 3.4 |
| Witcobond | 2.74 |
| Alphasan | 0.71 |
| Magnesium Chloride[1] | 0.008 |
| Hydrochloric Acid | to adjust pH to 6.0 |

(for a ratio of chloride ions to silver ions of about 2.5:1)

[1]Freecat MX ®, available from Noveon

Example 5

| Component | Amount (% by weight) |
|---|---|
| Water | 93.1 |
| Milease (anti-soil redeposition polymer) | 3.4 |
| Witcobond | 2.74 |
| Alphasan | 0.71 |
| Magnesium Chloride[1] | 0.008 |
| Hydrochloric Acid | to adjust pH to 6.0 |

(for a ratio of chloride ions to silver ions of about 1.3:1)

Example 6

| Component | Amount (% by weight) |
|---|---|
| Water | 93.1 |
| Milease (anti-soil redeposition polymer) | 3.4 |
| Witcobond | 2.74 |
| Alphasan | 0.72 |
| Magnesium Chloride[1] | 0.005 |
| Hydrochloric Acid | to adjust pH to 6.0 |

(for a ratio of chloride ions to silver ions of about 1:2)

Example 7

| Component | Amount (% by weight) |
|---|---|
| Water | 97.5 |
| Milease (anti-soil redeposition polymer) | 3.0 |
| Witcobond | 2.0 |

-continued

| Component | Amount (% by weight) |
|---|---|
| Alphasan | 0.6 |
| Hydrochloric Acid | to adjust pH to 6.0 |

(for a ratio of chloride ions to silver ions of about 1:10)

Comparative Example

| Component | Amount (% by weight) |
|---|---|
| Water | 93.1 |
| Milease (anti-soil redeposition polymer) | 3.4 |
| Witcobond | 2.74 |
| Alphasan | 0.73 |
| Hydrochloric Acid | to adjust pH to 6.0 |

A control fabric was also utilized within the tests below having no treatment applied thereto.

These solutions were then applied to sample fabrics (colored "true" white) via pad and nip rolls to give a wet pick up of about 85-90% owf. The exhaustion level of the active ALPHASAN® compounds on the target fabrics was about 1.0% owf. The sample coated, control, and comparative fabrics were then analyzed for a number of different characteristics, mostly in terms of measurements taken prior to and after a certain number of washes. For each wash test below, the sample fabric was laundered in accordance with AATCC Test Method 130-1981, basically with a standard home-type washing machine (Sears Kenmore® Heavy Duty, Super Capacity) equipped with a temperature controller set to wash at 105+/−5° F. The rinse temperature was set to cold (70+/−5° F.). Tide® powder detergent was utilized in an amount of about 100 g for a medium load, on a normal cycle (10 minute wash cycle; 28 minute total cycle). The sample fabric was then removed and dried in a standard home dryer on the cotton setting for 10 minutes. None of the produced fabrics above exhibited any electrical conductivity.

In terms of wash durability, Examples 1-3 were tested for ion release after 20 standard washes under a biological solution test (artificial sweat test).

Artificial Sweat Test

Such a test measures the amount of active metal ion that freely dissociates from the substrate to perform a desired function (such as antimicrobial activity for odor control or reduction) and can be performed on washed or unwashed samples to monitor durability of the releasable active ingredient, in this case, silver ions. The test itself involves subjecting the sample (a swatch of fabric having 4 inch by 4 inch dimensions in this instance) to a solution that is representative of the solution to which a sample would be exposed to perform its desired function. Thus, for this test, the sample fabrics were exposed to a human body odor control standard in accordance with the solution of AATCC Test Method 15-1994 after first being weighed to four significant digits. The exposure was essentially immersion in a tenfold dilution of the artificial standard solution for 8 hours. After the exposure time, the sample was then dried and weighed again; any loss in weight was then representative of release of the silver ion active ingredient to combat the odor producing microbes within the standard solution. The calculations are reported as ppm active ingredient on the weight of the sample fabric. The results were as follows for Example 1 and certain comparative fabrics (A is fabric included fibers extruded with 180 ppm per fiber ALPHASAN®; B is fabric with fibers extruded with 60 ppm per fiber ZEOMIC®; C is X-STATIC® electrically conductive fabric with 8000 ppm silver thereon:

TABLE 1

Silver Ion Release Measurements Via Artificial Sweat Test

| Number of Washes | Example 1 (ppb) | A (ppb) | B (ppb) | C (ppb) |
|---|---|---|---|---|
| 0 | 1023 | 504 | 107 | 2080 |
| 10 | 890 | 154 | 91 | 788 |
| 20 | 880 | 210 | 84 | 883 |

Thus, the inventive example retained greater than 86% of active silver ion after 20 washes; whereas the comparative examples were either extremely low in available silver ion (B), below 80% retention (all three, with A and C below 50% retention), or electrically conductive in nature (C).

Another indication of the effectiveness of the new binder system for this topical application is the measure of antimicrobial activity of the topical finish after a certain number of washes. Such silver-ion based finishes exhibit excellent antimicrobial activity which can lead to desired odor control, microbe killing, among other benefits. Preferably, effective finish retention (silver-ion release retention) is available when the sample fabric exhibits a log kill rate for *Staphylococcus aureus* of at least 1.5, preferably above 2.0, more preferably above 3.0, and a log kill rate for *Klebsiella pneumoniae* of at least 1.5, preferably above 2.0, and more preferably above 3.0, both as tested in accordance with AATCC Test Method 100-1993 for 24 hour exposure, after at least 10 washes, preferably more, as defined above. The results for the above Examples 1-3 are as follows:

TABLE 2

Log Kill Rates for *Staphylococcus aureus* and *Klebsiella pneumoniae* By Inventive Fabrics

| | | Log Kill Rates | |
|---|---|---|---|
| Example # | Washes | *S. aureus* | *K. pneumoniae* |
| 1 | 0 | 3.31 | 3.67 |
| 1 | 1 | 2.03 | 4.25 |
| 1 | 5 | 2.83 | 4.65 |
| 1 | 10 | 2.87 | 4.65 |
| 1 | 20 | 2.21 | 4.65 |
| 2 | 0 | 3.81 | 3.49 |
| 2 | 1 | 3.37 | 4.65 |
| 2 | 5 | 3.12 | 3.37 |
| 2 | 10 | 1.67 | 3.08 |
| 2 | 20 | 1.13 | 3.03 |
| 3 | 0 | 3.69 | 4.65 |
| 3 | 1 | 2.50 | 2.69 |
| 3 | 5 | 1.67 | 2.48 |
| 3 | 10 | 2.08 | 1.61 |
| 3 | 20 | 1.57 | 1.43 |
| Control | 0 | −0.04 | −0.95 |
| Control | 3 | 0.03 | −1.49 |

Thus, the retention of silver ions on the surface was, again, excellent for the inventive finishes.

Colorlightfastness

In terms of fabric discoloration, Examples 4-7 were analyzed under a colorlightfastness test measuring the sample in terms of the following equation:

$$\Delta E^* = ((L^*_{initial} - L^*_{exposed})^2 + (a^*_{initial} - a^*_{exposed})^2 + (b^*_{initial} - b^*_{exposed})^2)^{1/2}$$

wherein ΔE* represents the difference in color between the fabric upon initial latex coating and the fabric after the above-noted degree of ultra violet exposure. L*, a*, and b* are the color coordinates; wherein L* is a measure of the lightness and darkness of the colored fabric; a* is a measure of the redness or greenness of the colored fabric; and b* is a measure of the yellowness or blueness of the colored fabric. The lower the ΔE*, the better the colorlightfastness, and thus lower degree of color change, or in this situation, discoloration, of the fabric sample. The measurements on "true" white fabric (having initial measurements of L=93.93, a=2.10, and b=−10.68) were as follows for Examples 4-7, for exposure to a 225 kJ xenon light source for a specified amount of kilojoules in accordance with The Engineering Society for Advancing Mobility Land Sea Air and Space Textile Test method SAE J-1885, "(R) Accelerated Exposure of Automotive Interior Trim Components Using a Controlled Irradiance Water Cooled Xenon-Arc Apparatus".

TABLE 2

L Values For Sample Fabrics

| | Hours | | | | | | |
|---|---|---|---|---|---|---|---|
| Example # | 0 | 24 | 48 | 72 | 96 | 196 | 264 |
| 4 | 94.39 | 92.96 | 92.82 | 92.70 | 92.43 | 92.10 | 92.02 |
| 5 | 94.49 | 93.46 | 93.26 | 93.20 | 92.99 | 92.54 | 92.43 |
| 6 | 94.68 | 93.36 | 93.23 | 93.08 | 92.82 | 92.37 | 92.18 |
| 7 | 94.37 | 90.54 | 89.43 | 88.52 | 88.07 | 86.46 | 86.40 |
| Comparative | 94.74 | 88.28 | 87.07 | 86.12 | 85.78 | 84.52 | 84.69 |
| Control | 93.93 | 94.4 | 94.26 | 94.35 | 94.01 | 94.43 | 94.34 |

TABLE 3 a Values For Sample Fabrics

| | Hours | | | | | | |
|---|---|---|---|---|---|---|---|
| Example # | 0 | 24 | 48 | 72 | 96 | 196 | 264 |
| 4 | 2.07 | 2.30 | 2.34 | 2.52 | 2.81 | 2.46 | 2.53 |
| 5 | 2.04 | 2.24 | 2.32 | 2.49 | 2.79 | 2.43 | 2.48 |
| 6 | 2.06 | 2.30 | 2.34 | 2.56 | 2.86 | 2.88 | 2.56 |
| 7 | 2.10 | 3.65 | 4.11 | 4.46 | 4.47 | 4.49 | 4.34 |
| Comparative | 2.07 | 4.02 | 4.25 | 4.60 | 4.16 | 4.47 | 4.64 |
| Control | 2.10 | 2.27 | 2.26 | 2.45 | 2.80 | 2.82 | 2.80 |

TABLE 4 b Values For Sample Fabrics

| | Hours | | | | | | |
|---|---|---|---|---|---|---|---|
| Example # | 0 | 24 | 48 | 72 | 96 | 196 | 264 |
| 4 | −10.56 | −10.82 | −10.73 | −11.06 | −11.04 | −10.23 | −10.08 |
| 5 | −10.74 | −10.86 | −10.93 | −11.19 | −11.21 | −10.55 | −10.49 |
| 6 | −10.80 | −10.99 | −10.92 | −11.29 | −11.33 | −10.63 | −10.65 |
| 7 | −10.61 | −9.02 | −8.55 | −8.92 | −8.19 | −8.25 | −8.27 |
| Comparative | −10.62 | −6.93 | −6.43 | −6.25 | −5.43 | −5.76 | −5.75 |
| Control | −10.68 | −11.22 | −11.2 | −11.65 | −11.78 | −11.24 | −11.30 |

These values were then introduced into the equation above for a proper measurement in color change over time (as compared with the theoretical E value for "true" white fabrics) to determine the colorlightfastness of the inventive finished fabrics. The results were as follows:

TABLE 5

ΔE Values For Sample Fabrics

| | Hours | | | | | | |
|---|---|---|---|---|---|---|---|
| Example # | 0 | 24 | 48 | 72 | 96 | 196 | 264 |
| 4 | 0.11 | 0.50 | 0.65 | 0.92 | 1.44 | 1.84 | 2.10 |
| 5 | 0.16 | 0.14 | 0.28 | 0.47 | 0.82 | 1.02 | 1.22 |
| 6 | 0.29 | 0.23 | 0.30 | 0.65 | 1.12 | 1.52 | 1.63 |
| 7 | 0.10 | 8.33 | 14.40 | 18.96 | 23.10 | 33.75 | 33.81 |
| Comparative | 0.33 | 24.84 | 34.90 | 43.46 | 49.10 | 59.19 | 58.04 |
| Control | 0.00 | 0.27 | 0.20 | 0.62 | 0.85 | 0.56 | 0.52 |

These final values were then taken as a percentage of the ΔE values of the inventive and comparative examples divided by the ΔE values of the control to give a color stabilization rate and were calculated to be as follows:

TABLE 6

Color Stabilization Rates

| Example # | Percentage Color Change |
|---|---|
| 4 | 96.7 |
| 5 | 97.4 |
| 6 | 97.8 |
| 7 | 51.9 |
| Comparative | 0.0 |
| Control | 100 |

Thus, a color stabilization rate of at least 50% is acceptable and heretofore unattained. Higher rates are clearly more preferable, and, with the presence of halide ions are available. Thus, rates of at least 55%, more preferably at least 60%, still more preferably at least 75%, and more preferred at least 85% (with even higher rates most preferred) are desired of this inventive finish.

In any event, these levels are excellent and show the ability of the inventive finishes to provide not only effective antimicrobial levels, but also excellent reduction in discoloration possibilities, particularly over time and after an appreciable number of standard launderings.

There are, of course, many alternative embodiments and modifications of the present invention which are intended to be included within the spirit and scope of the following claims.

What is claimed is:

1. A method for making a coated fabric substrate comprising the steps of:

(a) providing a fabric substrate having a surface;

(b) contacting at least a portion of the surface of said fabric substrate of step "a" with a liquid finish, wherein said finish is non-electrically conductive and substantially free of alkali metal ions, said finish comprising a mixture of:

(i) at least one silver-ion containing compound selected from the group consisting of silver zirconium phosphate, silver zeolite, silver glass, and any mixtures thereof;

(ii) at least one halide-containing compound, wherein said halide-containing compound is present in an amount measured as a molar ratio between the amount of halide ions present and the amount of silver ions present, wherein said range is from 5:1 to 1:10;

(iii) at least one polyurethane binder compound; and (iv) at least one anti-soil redeposition compound.

2. The method of claim 1, wherein said step "b" of contacting is accomplished via dye bath exhaustion techniques.

3. The method of claim 1, wherein said silver-ion containing compound is a silver zirconium phosphate.

4. The method of claim 1 wherein said at least one halide-containing compound is a chloride-containing compound.

5. The method of claim 4, wherein said chloride-containing compound is magnesium chloride.

6. The method of claim 1, wherein said anti-soil redeposition compound is ethoxylated polyester.

7. The coated fabric substrate produced by the process of claim 1.

8. A method for coating, a fabric substrate with a liquid finish comprising the sequential steps of:

(a) providing a fabric substrate having a surface;

(b) contacting at least a portion of the surface of said fabric substrate with at least one silver-ion containing compound selected from the group consisting of silver zirconium phosphate, silver zeolite, silver glass, and any mixtures thereof; and (c) contacting at least a portion of the surface of said fabric substrate with at least one polyurethane binder compound;

wherein said liquid finish is non-electrically conductive and substantially free of alkali metal ions.

9. The method of claim 8, wherein said silver-ion containing compound is a silver zirconium phosphate.

10. The method of claim 8, wherein said finish further includes at least one halide-containing compound, wherein said halide-containing compound is present in an amount measured as a molar ratio between the amount of halide ions present and the amount of silver ions present, wherein said range is from 5:1 to 1:10.

11. The method of claim 10, wherein said at least one halide-containing compound is a chloride-containing compound.

12. The method of claim 11, wherein said chloride-containing compound is magnesium chloride.

13. The method of claim 8, wherein said finish further includes at least one anti-soil redeposition compound.

14. The method of claim 8, wherein said anti-soil redeposition compound is ethoxylated polyester.

15. The coated fabric substrate produced by the process of claim 8.

16. A method for making a coated fabric substrate comprising the steps of:

(a) providing a fabric substrate having a surface;

(b) contacting at least a portion of the surface of said fabric substrate of step "a" with a liquid finish, wherein said finish is non-electrically conductive and substantially free of alkali metal ions, said finish comprising a mixture of:

(i) at least one silver-ion containing compound selected from the group consisting of silver zirconium phosphate, silver zeolite, silver glass, and any mixtures thereof;

(ii) at least one halide-containing compound, wherein said halide-containing compound is present in an amount measured as a molar ratio between the amount of halide ions present and the amount of silver ions present, wherein said range is from 5:1 to 1:10;

(iii) at least one polyurethane binder compound; and (iv) at least one anti-soil redeposition compound;

wherein said step "b" of contacting said substrate is accomplished via dye bath exhaustion techniques.

17. The method of claim 16, wherein said silver-ion containing compound is a silver zirconium phosphate.

18. The method of claim 16, wherein said at least one halide-containing compound is a chloride-containing compound.

19. The method of claim 18, wherein said chloride-containing compound is magnesium chloride.

20. The method of claim 16 , wherein said anti-soil redeposition compound is ethoxylated polyester.

21. The coated fabric substrate produced by the process of claim 16.

* * * * *